US005569337A

United States Patent [19]

Yoshida et al.

[11] Patent Number: 5,569,337

[45] Date of Patent: Oct. 29, 1996

[54] GOLF-CLUB HEAD

[75] Inventors: Daisaku Yoshida; Katsumi Yamano, both of Kagawa-ken, Japan

[73] Assignees: Shintomi Golf Co., Ltd., Tokyo; Kasco Corporation, Kagawa-ken, both of Japan

[21] Appl. No.: 344,657

[22] Filed: Nov. 18, 1994

[30] Foreign Application Priority Data

Nov. 19, 1993 [JP] Japan ..... 5-290346

[51] Int. Cl.[6] ..... C22C 38/44; C22C 38/52

[52] U.S. Cl. ..... 148/325; 420/38; 473/324

[58] Field of Search ..... 148/325; 420/38; 273/167 H, 77 A

[56] References Cited

U.S. PATENT DOCUMENTS

| | | | |
|---|---|---|---|
| 3,251,683 | 5/1966 | Hammond . | |
| 3,340,048 | 9/1967 | Floreen . | |
| 3,861,909 | 1/1975 | Caton . | |
| 4,314,863 | 2/1982 | McCormick | 420/61 |
| 5,089,067 | 2/1992 | Schumacher | 148/325 |

FOREIGN PATENT DOCUMENTS

| | | |
|---|---|---|
| 0294210 | 12/1988 | European Pat. Off. . |
| 882187 | 11/1961 | United Kingdom . |
| 1020517 | 2/1966 | United Kingdom . |
| 1021405 | 3/1966 | United Kingdom . |

*Primary Examiner*—Deborah Yee
*Attorney, Agent, or Firm*—Oblon, Spivak, McClelland, Maier & Neustadt, P.C.

[57] ABSTRACT

A golf club head is formed of an alloy steel which comprises at most 0.2 wt. % of C, 0.05–1.0 wt. % of Si, at most 0.5 wt. % of Mn, 3.0–8.0 wt. % of Ni, 10.0–20.0 wt. % of Cr, 3.0–8.0 wt. % of Mo and 10.0–20.0 wt. % of Co, the remainder being substantially Fe, and has a metallic texture composed principally of martensite.

16 Claims, No Drawings

GOLF-CLUB HEAD

BACKGROUND OF THE INVENTION

1. Field of the Invention

The present invention relates to a metal head for a golf club, which is tough and has a relatively large volume without increasing the weight, and can be manufactured with ease.

2. Description of the Related Art

Metal wood heads and iron heads are generally produced by a precision casting process (lost wax process) using, as a material, a stainless steel such as SUS 630 [AISI (American Iron and Steel Institute) Standard Type 630]or SUS 431 (AISI Standard Type 431).

It is desirable for a golf-club head to make a golf club to which the head has been attached which is easy to swing and hard to cause a bad shot. Therefore, efforts have been made in reducing the weight of the head to make it easy to swing a golf-club to which the head has been attached, and widening the sweet spot in a face of the head or increasing the moment of inertia of the head to lessen the chance of a bad shot. With a wide sweet spot of the head, the course of flying of a hit ball becomes stable even if a hitting position in the face at which a ball is hit is irregular, and thus, the chance of a bad shot can be decreased.

On the other hand, a high moment of inertia of the head suppresses the turning of the head due to a shock upon hitting a golf ball, bringing a substantial widening of the sweet spot that stabilizes the course of flying of the hit ball.

In the case of a metal wood head of a hollow structure, for example, a portion near the sole of the head is made heavier than its crown to lower the center of gravity, whereby the sweet spot can be widened. It is also possible to increase the volume of the head, thereby to increase the moment of inertia of the head and widen the sweet spot.

In the case of an iron head on the other hand, a peripheral portion of the head, such as a toe or a heel, can be made heavier than a portion about the center of gravity of the head, thereby widening the sweet spot.

With an increased overall weight of a head, even if the sweet spot can be widened, it becomes difficult to swinging the golf-club to which the head has been attached. On the other hand, when the shell thickness of a head is thinned wholly or partly to suppress the weight, disadvantages of a reduced strength of the head and/or a lowered rebound of the ball upon hitting may arise. In the case of a head made of a conventional stainless steel, since the reduction of their thicknesses has reached the lower limit, widening of the sweet spot by the above-described methods is difficult to achieve.

There has been developed a golf-club head made of a titanium alloy. The titanium alloy has strength substantially equal to that of the stainless steel and a specific gravity lower than the stainless steel. The use of the metal lower in specific gravity permits the increase in the volume of the head and the peripheral portions of the head to be made heavier than other portions without increasing the overall weight of the head.

However, problems are pointed out that the titanium alloy is considerably expensive, and it requires a special vacuum melting casting machine for manufacturing a head by a precision casting process because of its high level of chemical activity.

SUMMARY OF THE INVENTION

Therefore, an object of the present invention is to provide a metal head for a golf club, which has a larger volume than that of the conventional one while keeping its strength without increasing the overall weight, and can be manufactured with ease.

According to the present invention, there is provided a golf-club head made of an alloy steel which comprises at most 0.2 wt. % of C, 0.05–1.0 wt. % of Si, at most 0.5 wt. % of Mn, 3.0–8.0 wt. % of Ni, 10.0–20.0 wt. % of 3.0–8.0 wt. % of Mo and 10.0–20.0 wt. % of Co, the reminder being substantially Fe, and has a metallic texture composed principally of martensite.

The above alloy steel may further comprise at least one metal selected from the group consisting of 0.03–0.5 wt. % of Al, 0.03–0.5 wt. % of Ti and 0.01–0.05 wt. % of Zr.

The above alloy steels may desirably constitute at least a sweet spot region of the face of the head.

The golf-club head according to the present invention may be a metal wood head or an iron head.

In the present invention, the alloy steels used as materials each have a specific gravity almost equal to that of a stainless steel such as SUS 630 (AISI Standard Type 630) or SUS 431 (AISI Standard Type 431) and strength higher than such a stainless steel, and stretch well. Therefore, the thicknesses of the heads can be thinned while keeping strength required of them, and increase in their volumes and optimum weight distribution can be performed without increasing their weights.

The alloy steel constituting each golf club head can be provided as an alloy steel having a metallic texture composed principally of martensite high in hardness, thereby favorably avoiding abrading or flawing. The proportion of the martensitic texture in the whole alloy steel is preferably at least 95%. In order to the strength of the alloy steel without lowering its corrosion resistance, the content of C in the alloy steel is desirably at most 0.2 wt. %. The content of Si may preferably be 0.05–1.0 wt. %, which is a proper amount as a deoxidizer more preferably 0.05–0.12 wt. %, most preferably 0.08–0.10 wt. %. The contents of Ni and Cr may preferably be 3.0–8.0 wt. % and 10.0–20.0 wt. %, which are proper amounts to form the metallic texture composed principally of martensite more preferably 3.0–5.0 wt. % and 13.5–16.0 wt. %, most preferably 4.0–4.3 wt. % and 14.5–15.0 wt. %, respectively. With respect to the content of Mo any amount less than 3.0 wt. %. results in an alloy steel insufficient in strength On the other hand any amount exceeding 8.0 wt. % results in an alloy steel poor in toughness and hence brittle. Accordingly, the content of Mo may preferably be 3.0–8.0 wt. %, more preferably 3.0–5.0 wt. %, most preferably 4.0–4.6 wt. %. With respect to the content of Co, any amount less than 10.0 wt. % results in an alloy steel increased in a ferritic texture. On the other hand any amount exceeding 20.0 wt. % results in an alloy steel increased in an austenitic texture In each case the hardness becomes low. Accordingly the content of Co may preferably be 10.0–20.0 wt. %, more preferably 13.0–16.0 wt. % most preferably 13.2–2–15.0 wt. %.

Further, Al, Ti and/or Zr may serve to deoxidize the alloy steel and enhance its strength in a small amount. The contents of Al, Ti, and Zr may preferably be within ranges of 0.03–0.5 wt. %, 0.03–0.5 wt. % and 0.01–0.05 wt. %, respectively.

The above and other objects, features and advantages of the present invention will become apparent from the following description and the appended claims.

DETAILED DESCRIPTION OF THE PREFERRED EMBODIMENTS

Alloy steels according to the present invention and an SUS 630 (AISI Standard Type 630) stainless steel as a comparative example, the contents of component elements of which are shown in table 1, were separately prepared. These steels were separately melted in an inert gas atmosphere, poured into a mold and solidified to form a martensitic texture, thereby producing golf club heads according to Examples 1 to 17 and Comparative Examples 1 and 2, which are shown in Table 2. The tensile strength, elongation, hardness and the like of these steels were controlled by changing the conditions of a heat treatment.

The mechanical properties of the alloy steels according to the present invention and the SUS 630 (AISI Standard Type 630) stainless steel as a comparative example are shown in Table 3.

In this case, Examples 1 to 16 are embodiments of metal wood heads, and Example 17 is an embodiment of an head (#5). The metal wood heads of Examples 15 and 16 are such that their faces are formed of their corresponding alloy steels and other portions thereof are formed of the SUS 630 (AISI Standard Type 630) stainless steel.

The heads according to Examples 1 to 17 and Comparative Examples 1 and 2 were separately manufactured with the thicknesses of their faces, and the weights and volumes thereof varied. Their actual-hit durability was evaluated by separately setting golf clubs obtained by attaching a shaft and a grip to the heads in a swing robot and repeatedly hitting a golf ball. The results are shown in table 2. The durability was ranked as AA in case of "very good", A in case of "good", B in case of "somewhat poor", or C in case of "poor".

Accordingly, the alloy steels according to the present invention are higher in strength and better stretched compared with the SUS 630 (AISI Standard Type 630) stainless steel, and so they can be sufficiently thinned without impairing the durability.

Furthermore, with respect to the reduction of area, the SUS 630 (AISI Standard Type 630) stainless steel is within a range of 12.0–17.9% for the tensile strength ranging from 119.2 to 126.3 kgf/mm$^2$, while the alloy steels according to the present invention are within a range of 20.4–51.3% for the tensile strength ranging from 121.5 to 182.4 kgf/mm$^2$. Therefore, the reduction of area is also improved.

Accordingly, in Examples 1 and 7 shown in table 2, the heads were able to be thinned in face thickness, and reduced in weight for the same volume as the head of Comparative Example 1. In addition, very good actual-hit durability was obtained. In this case, it is considered that the reduction in the weights of the heads permits easy swinging.

In addition, when Examples 4, 9, 10–14 and 16 were compared with Comparative Example 2, remarkable differences arose in actual-hit durability between them even if they were equal to each other in face thickness, head weight and head volume. This means that the strength of the faces in particular was improved. In the case of Examples 4, 9, 10–14 and 16, the heads were increased in volume to a significant extent compared with the head of Comparative Example 1, and the actual-hit durability was also improved. In this case, the widening of sweet spot is realized. Furthermore, in Example 5, the head was made thinner in face thickness and greater in volume than both heads of Comparative Examples 1 and 2. Even in this case, good actual-hit durability was obtained.

TABLE 1

| | Inventive alloy steel (wt. %) | | | | | | | | SUS 630 (AISI Standard Type 630) |
|---|---|---|---|---|---|---|---|---|---|
| | No. 1 | No. 2 | No. 3 | No. 4 | No. 5 | No. 6 | No. 7 | No. 8 | (wt. %) |
| C | 0.02 | 0.03 | 0.03 | 0.04 | 0.007 | 0.005 | 0.006 | 0.003 | 0.04 |
| Si | 0.10 | 0.08 | 0.08 | 0.10 | 0.08 | 0.08 | 0.10 | 0.10 | 0.60 |
| Mn | 0.10 | 0.10 | 0.08 | 0.10 | 0.04 | 0.03 | 0.04 | 0.04 | — |
| Ni | 4.00 | 4.20 | 4.30 | 4.20 | 4.50 | 6.50 | 3.10 | 3.20 | 4.00 |
| Cr | 15.00 | 14.70 | 14.70 | 14.50 | 10.00 | 10.00 | 12.00 | 17.30 | 16.50 |
| Mo | 4.00 | 4.50 | 4.50 | 4.60 | 3.80 | 4.50 | 7.40 | 3.60 | — |
| Co | 15.00 | 13.20 | 14.20 | 15.00 | 16.40 | 16.60 | 16.30 | 11.20 | — |
| Al | — | 0.05 | 0.06 | — | — | — | — | — | — |
| Ti | — | — | 0.06 | — | — | — | — | — | — |
| Zr | — | — | — | 0.03 | — | — | — | — | — |
| Cu | — | — | — | — | — | — | — | — | 4.00 |
| Nb | — | — | — | — | — | — | — | — | 0.27 |
| Fe | Balance | Balance | Balance | Balance | Balance | Balance | Balance | Balance | Balance |

In table 3, the specific gravities of the alloy steels according to the present invention and the SUS 630 (AISI Standard Type 630) stainless steel of the comparative example are 7.9–8.1, and 7.8, respectively. Therefore, these steels can be considered to have substantially the same specific gravity. On the other hand, the tensile strength of the SUS 630 (AISI Standard Type 630) stainless steel is 119.1–126.3 kgf/mm$^2$, while those of the alloy steels according to the present invention are within a range of 121.5–182.4 kgf/mm$^2$. It was therefore revealed that the alloy steels have a strength equal to or higher than the SUS 630 (AISI Standard Type 630) stainless steel. Further, with respect to the elongation, the SUS 630 (AISI Standard Type 630) stainless steel is within a range of 5.3–8.0% for the tensile strength of 119.1 kgf/mm$^2$ or higher, while the alloy steels of the present invention having tensile strengths of 121.5 kgf/mm$^2$ and 182.4 kgf/mm$^2$, respectively, are 20.9% and 9.2%, respectively.

TABLE 2

| | Alloy steel | Thickness of face (mm) | Weight (g) | Volume (cc) | Actual-hit durability |
|---|---|---|---|---|---|
| Ex. 1 | No. 1 | 2.3 | 192 | 185 | AA |
| Ex. 2 | No. 1 | 2.5 | 196 | 185 | AA |
| Ex. 3 | No. 1 | 2.7 | 200 | 185 | AA |
| Ex. 4 | No. 1 | 2.5 | 200 | 250 | AA |
| Ex. 5 | No. 1 | 2.3 | 200 | 260 | A |
| Ex. 6 | No. 1 | 2.5 | 200 | 250 | A |
| Ex. 7 | No. 2 | 2.3 | 193 | 185 | AA |
| Ex. 8 | No. 2 | 2.5 | 200 | 250 | A |
| Ex. 9 | No. 3 | 2.5 | 200 | 250 | AA |
| Ex. 10 | No. 4 | 2.5 | 200 | 250 | AA |
| Ex. 11 | No. 5 | 2.5 | 200 | 250 | AA |
| Ex. 12 | No. 6 | 2.5 | 200 | 250 | AA |

TABLE 2-continued

| | Alloy steel | Thickness of face (mm) | Weight (g) | Volume (cc) | Actual-hit durability |
|---|---|---|---|---|---|
| Ex. 13 | No. 7 | 2.5 | 200 | 250 | AA |
| Ex. 14 | No. 8 | 2.5 | 200 | 250 | AA |
| Ex. 15 | No. 2 | 2.3 | 200 | 250 | A |
| Ex. 16 | No. 2 | 2.5 | 200 | 250 | AA |
| Ex. 17 | No. 2 | 2.2 | 265 | — | A |
| Comp. Ex. 1 | — | 2.5 | 195 | 185 | B |
| Comp. Ex. 2 | — | 2.5 | 200 | 250 | C |

TABLE 3

| Inventive alloy steel | Heat treatment conditions | Tensile strength (kgf/mm$^2$) | Tensile strength (ksi) | Elongation (%) | Reduction of area (%) | Specific gravity | Hardness (HRC) |
|---|---|---|---|---|---|---|---|
| No. 1 | 1040° C. × 1.5 h + 540° C. × 6 h | 180.0 | 256.0 | 10.2 | 25.0 | 7.9 | 50 |
| No. 1 | 1040° C. × 1.5 h + 510° C. × 1 h | 121.5 | 172.8 | 20.9 | 51.3 | 7.9 | 38 |
| No. 1 | 1040° C. × 1.5 h + 540° C. × 2 h | 165.0 | 234.7 | 13.0 | 31.4 | 7.9 | 48 |
| No. 2 | 1040° C. × 1.5 h + 540° C. × 6 h | 180.2 | 256.3 | 10.4 | 26.4 | 7.9 | 50 |
| No. 2 | 1040° C. × 1.5 h + 480° C. × 3 h | 153.7 | 218.6 | 15.1 | 38.5 | 7.9 | 46 |
| No. 2 | 1040° C. × 1.5 h + 480° C. × 1.5 h | 130.0 | 184.9 | 19.3 | 47.2 | 7.9 | 40 |
| No. 3 | 1040° C. × 1.5 h + 540° C. × 6 h | 182.4 | 259.5 | 9.2 | 20.4 | 7.9 | 51 |
| No. 4 | 1040° C. × 1.5 h + 540° C. × 6 h | 182.1 | 259.0 | 9.8 | 20.6 | 7.9 | 51 |
| No. 5 | 1040° C. × 1.5 h + 540° C. × 6 h | 181.5 | 258.2 | 11.0 | 24.3 | 8.0 | 50 |
| No. 6 | 1040° C. × 1.5 h + 540° C. × 6 h | 178.2 | 253.5 | 13.0 | 25.4 | 8.1 | 49 |
| No. 7 | 1040° C. × 1.5 h + 540° C. × 6 h | 180.2 | 256.3 | 11.5 | 24.0 | 8.1 | 50 |
| No. 8 | 1040° C. × 1.5 h + 540° C. × 6 h | 179.2 | 254.9 | 12.0 | 25.1 | 7.9 | 50 |
| SUS 630 | 1040° C. × 1.5 h + 540° C. × 4 h | 119.1 | 169.4 | 8.0 | 17.9 | 7.8 | 38 |
| (AISI Standard Type 630) | 1040° C. × 1.5 h + 480° C. × 1 h | 126.3 | 179.7 | 5.3 | 12.0 | 7.8 | 39 |

The golf club heads according to the present invention are made of the alloy steels each having a specific gravity almost equal to that of a stainless steel such as SUS 630 (AISI Standard Type 630) or SUS 431 (AISI Standard Type 431) and strength higher than such a stainless steel.

For example, in the case of metal wood heads having the same weight, therefore, the thickness of the head according to the present invention can be thinned compared with a head made of the conventional stainless steel to increase its volume or make a portion near a sole of the head heavier than other portions. As a result, the sweet spot of the head can be widened while keeping strength required of the head to ensure that the direction of a hit ball is made stable. Incidentally, if the volume of the head is adjusted to the same volume as a head made of the conventional stainless steel, the weight of the head becomes reduced, thereby facilitating swinging. Even in the case of an iron head, the thickness of its face can be similarly thinned to make its peripheral portion heavier than other portions.

Upon the manufacturing of the above-described golf club heads by a precision casting process, the alloy steels can be melted in an inert gas atmosphere. Therefore, such heads can be mass-produced with ease.

What is claimed is:

1. A golf-club head comprising a face, said face comprising an alloy steel which comprises at most 0.2 wt. % of C, 0.05–1.0 wt. % of Si, at most 0.5 wt. % of Mn, 3.0–8.0 wt. % of Ni, 10.0–20.0 wt. % of Cr, 3.0–8.0 wt. % of Mo and 10.0–20.0 wt. % of Co, the remainder being substantially Fe, and has a metallic texture composed principally of martensite, wherein said golf-club head has a face with a thickness of 2.7–2.2 mm.

2. The golf-club head according to claim 1, wherein the alloy steel constitutes at least a sweet spot region of a face of the head.

3. The golf-club head according to claim 1 or 2, wherein the head is a metal wood head.

4. The golf-club head according to claim 1 or 2, wherein the head is an iron head.

5. A golf-club head according to claim 1, wherein said alloy steel further comprises at least one selected from the group consisting of 0.03–0.5 wt. % of Al, 0.03–0.5 wt. % of Ti and 0.01–0.05 wt. % of Zr.

6. The golf club head according to claim 5, wherein the alloy steel constitutes at least a sweet spot region of the face of the head.

7. The golf club head according to claim 5 or 6, wherein the head is a metal wood head.

8. The golf club head according to claim 5 or 6, wherein the head is an iron head.

9. The golf-club head according to claim 1, wherein said alloy steel comprises 0.08–0.10 wt. % of Si, 4.0–4.3 wt. % of Ni, 14.5–15.0 wt. % of Cr, 4.0–4.6 wt. % of Mo and 13.2–15.0 wt. % of Co.

10. The golf-club head according to claim 1, wherein said alloy steel has at least 95% martensitic texture.

11. The golf-club head according to claim 1, comprising said face, and other portions, wherein said other portions comprise SUS630 stainless steel.

12. The golf-club head according to claim 1, wherein said alloy steel has a tensile strength of 121.5–182.4 kgf/mm$^2$.

13. The golf-club head according to claim 1, wherein said golf-club head has a face with a thickness of 2.5–2.2 mm.

14. The golf-club head according to claim 1, wherein said golf-club head has a face with a thickness of 2.3–2.2 mm.

15. The golf-club head according to claim 5, wherein said golf-club head has a face with a thickness of 2.3–2.2 mm, and wherein said alloy steel comprises 0.08–0.10 wt. % of Si, 4.0–4.3 wt. % of Ni, 14.5–15.0 wt. % of Cr, 4.0–4.6 wt. % of Mo and 13.2–15.0 wt. % of Co.

16. The golf-club head according to claim 1, wherein said golf-club head is produced by a precision casting process.

* * * * *